United States Patent [19]

Broersma et al.

[11] Patent Number: 4,897,888

[45] Date of Patent: Feb. 6, 1990

[54] HELMET STRAP CLIP, AND ASSEMBLY

[75] Inventors: Lester V. Broersma, Bellflower, Calif.; Fritz W. Wurster, Waldstetten, Fed. Rep. of Germany

[73] Assignee: Bell Bicycles, Inc., Norwalk, Calif.

[21] Appl. No.: 280,821

[22] Filed: Dec. 7, 1988

[51] Int. Cl.[4] ..... A42B 3/00

[52] U.S. Cl. ..... 2/421; 24/519

[58] Field of Search ..... 2/416, 421; 24/165, 24/172, 197, 200, 519

[56] References Cited

U.S. PATENT DOCUMENTS 2,759,176 11/1956 Grancsay et al. ..... 2/421 X
2,769,176 9/1954 Gracsay et al. .
2,846,683 8/1958 Dye et al. .
3,925,821 12/1975 Lewicki .
4,044,400 8/1977 Lewicki et al. .
4,110,847 9/1978 Dera .
4,461,044 7/1984 Reiterman et al. ..... 2/421

FOREIGN PATENT DOCUMENTS 3300277 12/1984 Fed. Rep. of Germany ..... 2/421

*Primary Examiner*—Werner H. Schroeder
*Attorney, Agent, or Firm*—William W. Haefliger

[57] ABSTRACT

A helmet strap clip assembly includes two clip elements, each connectible to a helmet strap or straps, the two elements having interconnectible tongue and groove parts whereby they are connectible together and disconnectible from one another in response to finger pressure exertion thereon, the connection enabling guiding of one clip element onto the other and into registered position, for interconnection.

15 Claims, 3 Drawing Sheets

HELMET STRAP CLIP, AND ASSEMBLY

BACKGROUND OF THE INVENTION

This invention relates generally to bicycle helmet retention, and more particularly concerns improvements in chin strap junction plates; and in chin strap connection to helmets and their conformability to wearers, including quick connection and dis-connection and ready adjustability. This invention improves upon the invention of U.S. Pat. No. 4,461,044.

There is continuing need for a bicycle or motorcycle helmet retention harness having the following characteristics:

(1) means for quick, one-handed connection, as well as disconnection, obviating need for repeated adjustment of harness webs or straps each time the helmet is worn;

(2) conformability of the junction plate connections or clips to the angle of the wearer's jaw;

(3) construction of strap connections to allow back-strap location well under the earlobes;

(4) construction of strap junction plate connections permitting positive connection of the straps to the helmet;

(5) adjustability of helmet straps to junction plates while preventing unwanted strap slippage;

(6) loosening adjustment of a chin strap achieved merely by tilting of a junction plate element, and (7) means allowing guiding of a junction plate element into position for connection.

SUMMARY OF THE INVENTION

It is a major object of the invention to provide an improved junction plate clip structure usable with a chin strap and also forward and rearward straps, and satisfying the above needs.

Basically, the clip structure includes:

(a) a first upright clip element having forward slot means connectible with the forward strap, and rearward slot means connectible with the rearward strap, (b) a second upright clip element having lower slot means connectible with the chin strap, (c) the two elements having interconnectible tongue and groove means whereby they are connectible together and disconnectible from one another in response to finger pressure exertion thereon.

As will be seen, the two clip elements typically have opposed faces brought into predetermined face-to-face registration in response to interconnection of the tongue and groove means. Also, the two clip elements may typically form a Y-shaped assembly with two upper diverging portions and a lower stem portion, the forward and rearward slot means located at said upper diverging portions, and said lower slot means located at said lower stem portion. Accordingly, very quick and easy adjustment and connection of the assembly to the wearer's face is achieved, the connection made by relative self-guiding of the clip elements into registered positions for push-interconnection, and their disconnection facilitated by lift-pivoting of one clip element relative to and away from the other.

Additional objects include the provision of the second clip element to define the lower stem portion, and also to have an upper stem portion which partly overlies the two upper diverging portions which are defined by the first clip element; and the provision of the interconnectible tongue and groove means to include:

(i) upper tongue and groove parts located generally between said forward and rearward slot means, (ii) lower tongue and groove parts located above said lower slot means.

An additional object is to provide generally vertical interfit of the upper tongue and groove parts in response to downward motion of the second clip element relative to the first clip element, the upper tongue part projecting generally vertically; and the provision for interfit of the lower tongue and groove parts in response to motion of the second clip element bringing said face-to-face elements into predetermined registration, the lower tongue part projecting generally normal to said faces. Typically, the two clip elements have V-shaped surfaces which are interengageable to act as guides in response to said bringing of the elements into predetermined registration.

These and other objects and advantages of the invention, as well as the details of an illustrative embodiment, will be more fully understood from the following specification and drawings, in which:

DRAWING DESCRIPTION

FIG. 9 is a vertical section taken on lines 9—9 of

DETAILED DESCRIPTION

Figure 1:
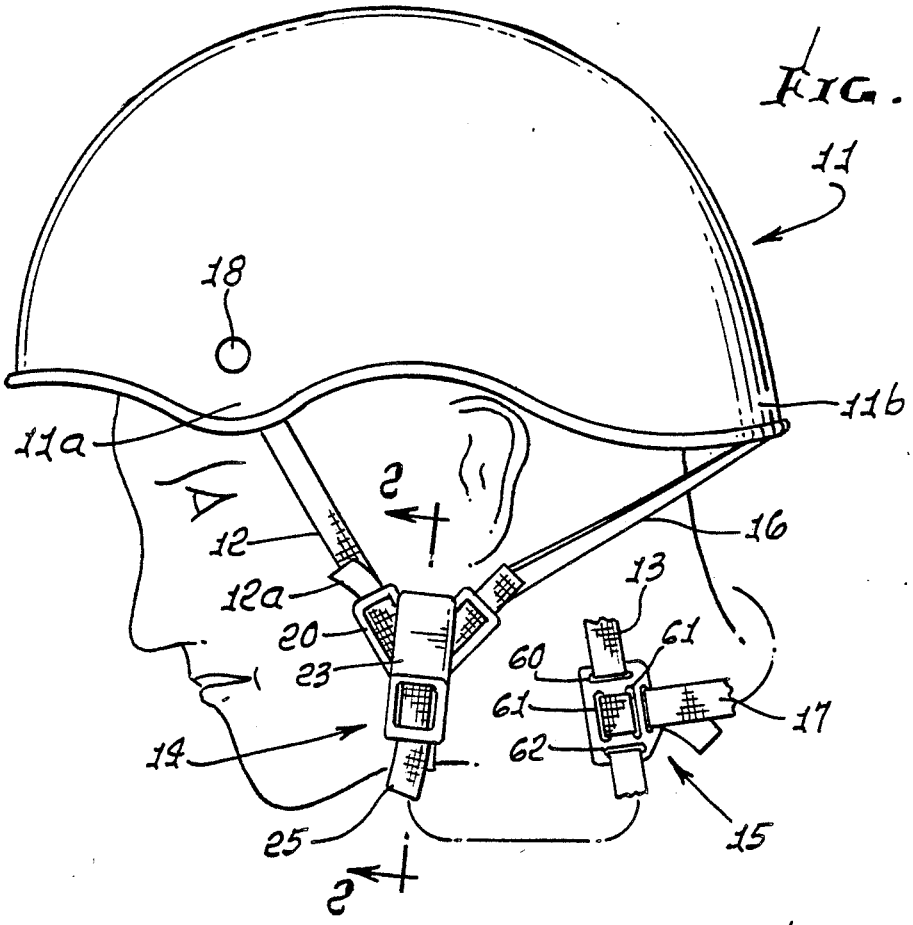
FIG. 1 is a side view of a helmet system incorporating the invention.

FIG. 1 shows the provision of a retention system or harness for a lightweight helmet 11. The system comprises left and right forward retention strap sections 12 and 13 attached to the helmet forward extent 11*a*; left and right junction plate units 14 and 15, respectively attached to the strap sections 12 and 13; and rear strap sections 16 and 17 attached to the helmet rearward extent 11*b*, and also to units 14 and 15. In FIG. 1, the plate unit 15 is shown shifted out of position, for visibility. See also chin strap 25.

The strap sections 12 and 13 may for example extend upwardly and inwardly into the helmet for suitable attachment to the helmet, as indicated by the fastener 18 for strap section 12. A similar fastener attaches strap section 13 to the right side of the helmet; and fasteners or other means attach the strap sections 16 and 17 to the rear of the helmet. Various other methods of strap connection may be provided, the present invention being primarily directed to the junction plate unit 14, rather than to the methods of strap connection to the helmet.

Referring now to FIGS. 2, 3, 6, 7 and 8, the junction plate unit 14 includes clip structures incorporating:

(a) a first upright clip element, as indicated at 20, having forward slot means generally indicated at 50–52 connectible with the forward strap 12, and rearward slot means generally indicated at 53–55, connectible with the rearward strap 16;

(b) a second upright clip element, as indicated at 23, having lower slot means generally indicated at 24, connectible with the chin strap 25;

(c) the two clip elements having interconnectible tongue and groove means whereby they are connectible together and disconnectible from one another in response to finger pressure exertion thereon The first clip element 20 has generally V-shaped plate form, with a lower region 20*a*, and two branches 20*b* and 20*c*; whereas the second clip element 23 has generally vertically elongated plate form, with a lower region 23*a* projecting below the level of 20*a*, and an upper region 23*b* projecting at the level of 20*b* and 20*c*. Note downward taper of region 23*a*, in FIG. 7. The two clip element plates have opposed, generally parallel faces 20*d* and 23*c* (see FIG. 2) which are brought into registration in response to interconnection of the tongue and groove means referred to above. When this is accomplished, the two assembled clip elements have a Y-shaped configuration, as seen in FIG. 3.

Figure 2:
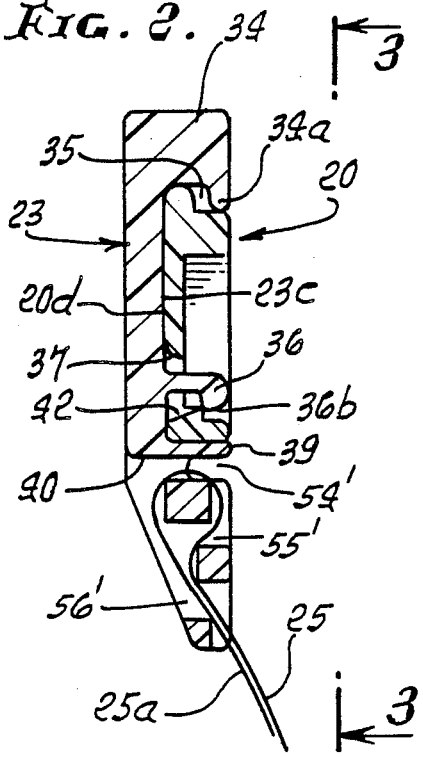
FIG. 2 is an enlarged vertical section taken the two clip element assembly, on lines 2—2, in FIG. 1.
Figure 3:
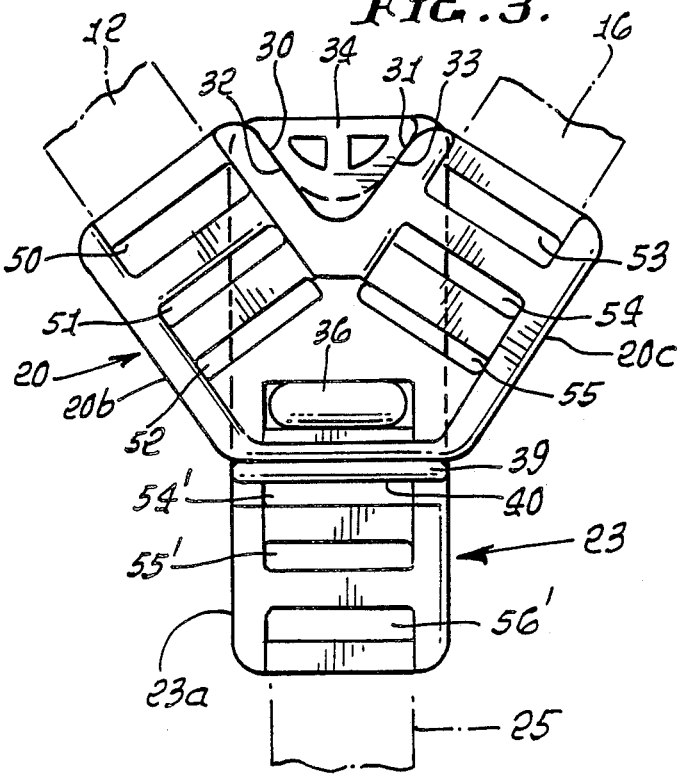
FIG. 3 is a vertical elevation taken on lines 3—3 of FIG. 2.

As seen in FIG. 3, the two clip elements have V-shaped surfaces which are interengageable to act as guides in response to bringing of the two elements into predetermined registration. See V-shaped guide edge surfaces 30 and 31 on clip element 20; and V-shaped guided surfaces 32 and 33 on the element 23. Surfaces 32 and 33 are on a hook shaped projection 34 from plate extent 23*d*, and projection 34 defines a downwardly extending tongue 34*a* that is guided into a groove 35 defined by the element 20, at its rear side (see FIG. 2) as element 23 is lowered relative to element 20. Accordingly, the helmet wearer merely places projection 34 between the guide surfaces 30 and 31, and lowers it, to cause the projection 34 to guide on surfaces 30 and 31 and tongue 34*a* to enter the groove 35, thereby hooking the two clip elements together.

Figure 5:
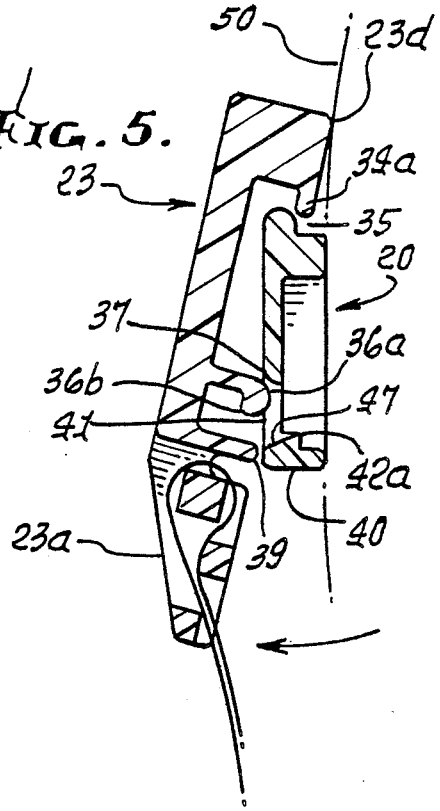
FIG. 5 is a view like FIG. 2, showing tilt disconnection of the two clip elements.
Figure 6:
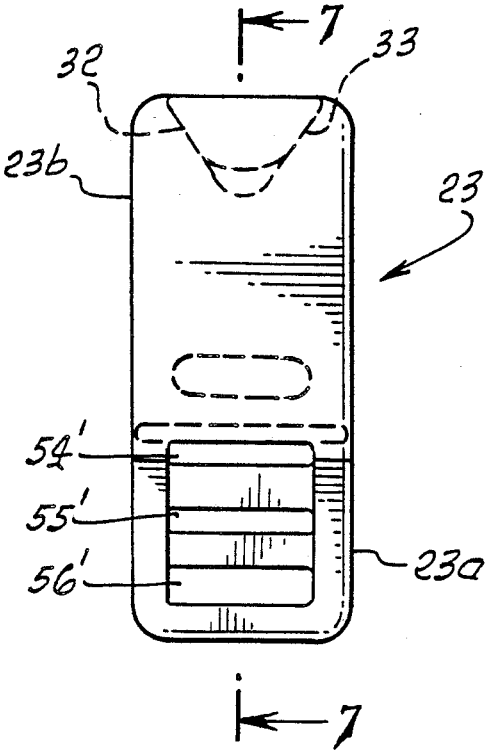
FIG. 6 is a front elevation showing the second clip element, which acts as a hook.
Figure 7:
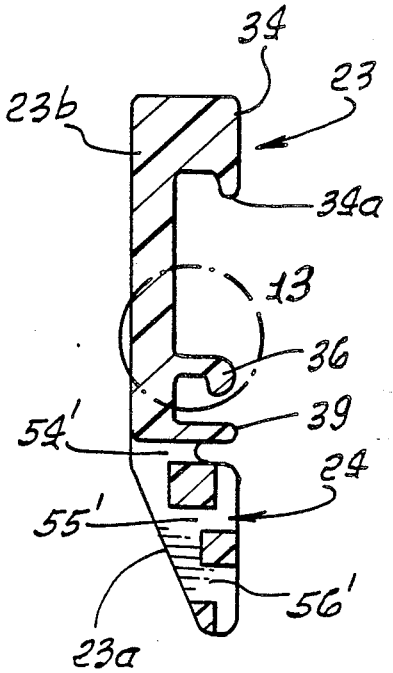
FIG. 7 is a section on lines 7—7 of FIG. 6.
Figure 8:
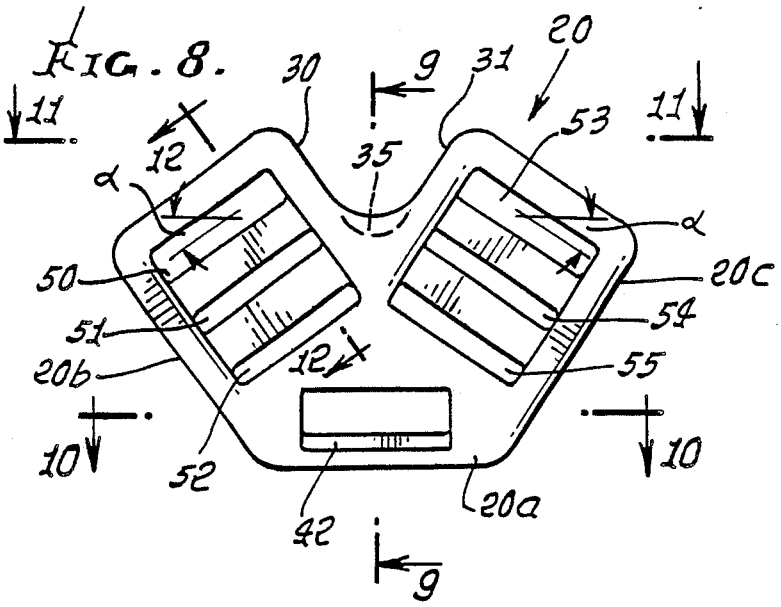
FIG. 8 is a front elevation showing the first clip element, which is typically Y-shaped and acts as a buckle.
Figure 9:
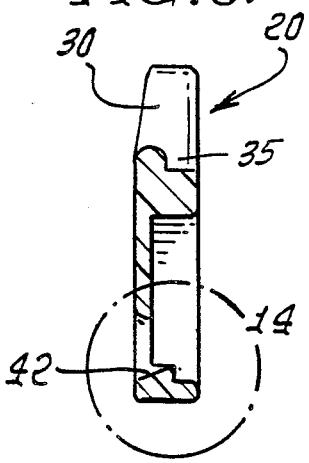
Figure 10:
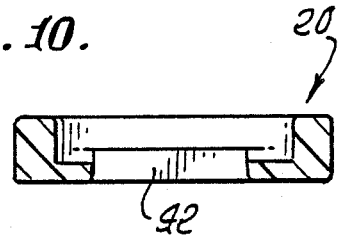
FIG. 10 is a horizontal section taken on lines 10—10 of FIG. 8.
Figure 13:
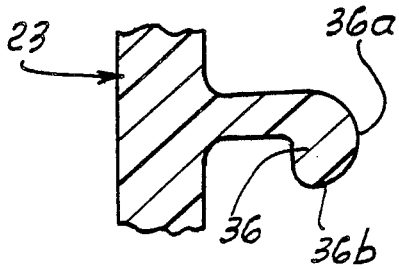
FIG. 13 is a fragmentary section on lines 13—13 of FIG. 7.
Figure 11:
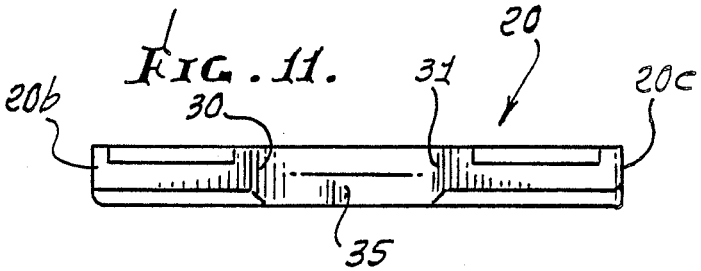
FIG. 11 is a plan view on lines 11—11 of FIG. 8.
Figure 14:
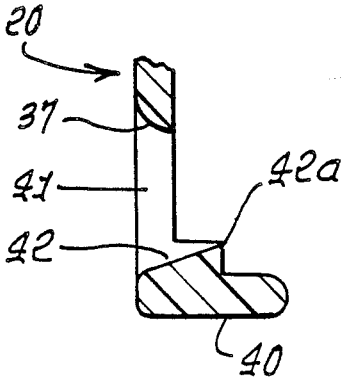
FIG. 14 is a fragmentary section taken on lines 14—14 of FIG. 9.

Thereafter, the user merely pushes the lower extent 23*a* of element 23 toward the element 20, bringing them into engagement as seen in FIG. 2, element 23 pivoting at 23*d* on the wearer's cheek 50 which seats element 20. See FIG. 5. During pushing of element 23 toward 20, a convex nose upper surface 36*a* on a tongue 36 integral with element 23 cams against the convex lower surface 37 on the element 20, which causes lowering of the element 23 relative to element 20, as seen in FIG. 5, whereby the tongue 34*a* is caused to downwardly enter the slot, until V-edges 32 and 33 bottom on V-edges 30 and 31, as seen in FIG. 3. Thereafter, as element 23 is forcibly further pushed toward element 20, the convex nose lower surface 36*b* on tongue 36 engages the ramp 42 on element 20, and rides over the ramp crest 42*a* with accompanying slight spring deflection upwardly of the cantilevered tongue 36. See FIG. 2. During such deflection, the element 23 is held in downward position by sliding engagement of a projection 39 on the element 23 with the lower horizontal surface 40 of element 20. See FIG. 2. Accordingly, the elements 20 and 23 are held together, forcibly, by its detented hooking connection of the tongue nose surface 36*b*, with the ramp crest 42*a*, the tongue 36 having entered the groove 41 defined between 37 and 42.

Figure 4:
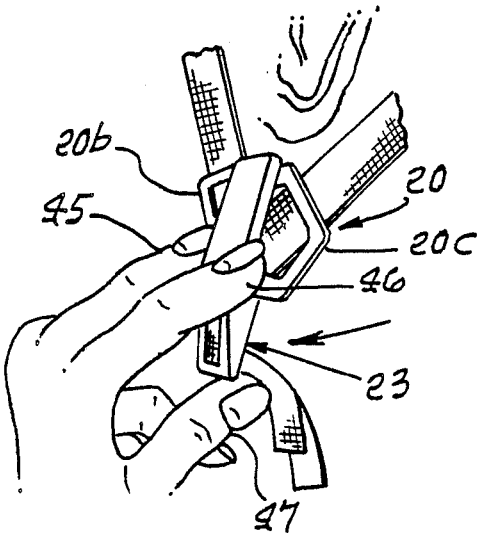
FIG. 4 is a perspective view showing tilt-disconnection of the two clip elements.

Disconnection of the element 23 from element 20 is easily effected as by pushing inwardly (rightwardly in FIG. 2) on V-sections or branches 20*b* and 20*c*, using two fingers (see FIG. 4) 45 and 46 while holding the lower end of section 23 against inward deflection, as by use of the thumb 47. This releases the tongue 36 from the ramp 42, and it rides leftwardly over the ramp crest, as accommodated by the pivoting action of the tongue 34*a* in groove 35.

Means is provided for interconnecting strap 12 with the branch 20*b* of element 20. Branch 20*b* includes multiple generally forwardly extending slots in which strap or webbing 12 is threaded, for strap length adjustment and plate retention. Three such slots are shown at 50–52 extending in parallel relation, forwardly and downwardly, at angle $\alpha$ from horizonatal. Angle C $\alpha$ is between 30° and 40° (and preferably about 35°) to conform the strap to the helmet and to the face and jaw of the wearer, and also to accommodate connection and disconnection of the elements 20 and 23, as described.

Figure 12:
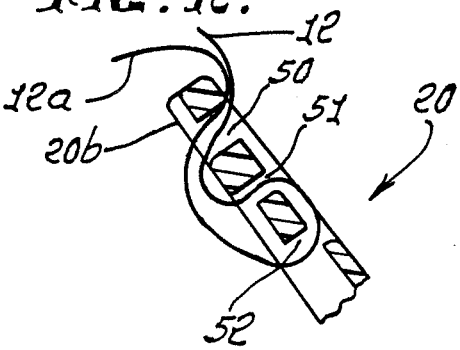
FIG. 12 is a fragmentary section on lines 12—12 of FIG. 8.

Strap 12 passes from the inside to the outside of upper slot 50, then downwardly and from the outside to the inside of middle slot 51, then passes downwardly and outwardly from the inside to the outside of lower slot 52; it then passes upwardly and inwardly from the outside to the inside of upper slot 50; and then extending freely upwardly as a tab 12*a*, for finger gripping and adjustment. Slot 50 has upper and inner edges to pinch strap 12 portions preventing slip. See FIG. 12.

A similar construction is imparted to branch 20*c* as exemplified by parallel slots 53–55 (corresponding in function and structure to slots 50–52), to retain strap 16. See also tab 16*a*. Slots 53–55 extend rearwardly and downwardly at angle $\alpha$ from horizontal, where $\alpha$ is between 30° and 40°, and is preferably about 35°.

The clip element 23 projects downwardly and defines parallel through slots 54–56 that extend generally forwardly and rearwardly, one above the other. See FIG. 2 which also shows how strap 25 interfits these slots, and defines an adjustment tab 25*a*.

In FIG. 1, the retainer or clip 15 used at the opposite side of the wearer's face may be a one-piece unit with appropriate slots 60–62 to receive and retain the straps 13, 17 and 25, as shown.

I claim:

1. For use with a helmet chin strap and forward and rearward straps connected to and depending from the helmet, a clip structure, comprising (a) a first upright clip element having forward slot means connectible with the forward strap, and rearward slot means connectible with the rearward strap, (b) a second upright clip element having lower slot means connectible with the chin strap, (c) the two elements having upper and lower pairs of interconnectible tongue and groove means whereby they are connectible together and disconnectible from one another in response to finger pressure exertion thereon.

2. The combination of claim 1 wherein the two clip elements have opposed faces brought into predetermined face-to-face registration in response to interconnection of the tongue and groove means.

3. The combination of claim 1 wherein the two-clip elements when interconnected form a Y-shaped assembly with two upper diverging portions and a lower stem portion, the forward and rearward slot means located at said upper diverging portions, and said lower slot means located at said lower stem portion, the upper pair of tongue and groove means located between said two upper diverging portions defined by the first clip element.

4. The combination of claim 3 wherein the second clip element defines said lower stem portion, and also has an upper stem portion which partly overlies said two upper diverging portions which are defined by the first clip element.

5. For use with a helmet chin strap and forward and rearward straps connected to and depending from the helmet, a clip structure, comprising (a) a first upright clip element having forward slot means connectible with the forward strap, and rearward slot means connectible with the rearward strap, (b) a second upright clip element having lower slot means connectible with the chin strap, (c) the two elements having interconnectible tongue and groove means whereby they are connectible together and disconnectible from one another in response to finger pressure exertion thereon, (d) the two clip elements when interconnected forming a Y-shaped assembly with two upper diverging portions and a lower stem portion, the forward and rearward slot means located at said upper diverging portions, and said lower slot means located at said lower stem portion, (e) said interconnectible tongue and groove means including (i) upper tongue and groove parts located generally between said forward and rearward slot means, (ii) lower tongue and groove parts located above said lower slot means.

6. The combination of claim 5 wherein said upper tongue and groove parts interfit generally vertically in response to downward motion of the second clip element relative to the first clip element, the upper tongue part projecting generally vertically.

7. The combination of claim 6 wherein said lower tongue and groove elements interfit in response to motion of the second clip element bringing said face-to-face elements into predetermined registration, said lower tongue part projecting generally normal to said faces.

8. The combination of claim 7 wherein said two elements have V-shaped surfaces which are interengageable to act as guides in response to said bringing of the elements into predetermined registration.

9. The combination of claim 6 wherein said two elements have V-shaped surfaces which are interengageable to act as guides in response to said bringing of the elements into predetermined registration, said V-shaped surfaces located proximate said upper tongue and groove parts.

10. The combination of claim 1 including said helmet chin strap connected to said lower slot means.

11. The combination of claim 10 including said helmet forward and rearward straps connected to said forward and rearward slot means, respectively.

12. The combination of claim 7 wherein said lower tongue and groove means form a detent connection.

13. The combination of claim 11 including the helmet connected with said chin strap and with said forward and rearward straps.

14. The combination of claim 1 wherein said clip elements consist of molded plastic material.

15. The combination of claim 12 wherein the lower tongue has (i) an upper convex nose surface to cam against a first lower surface defined by the first element, thereby to cause the lower tongue to enter the lower groove, and (ii) a lower convex nose surface to cam against a ramp defined by the first element, thereby to cause spring deflection of the lower tongue, which is cantilevered, and retention of the lower nose surface adjacent a crest defined by the ramp, when the two elements are in face-to-face interengagement.

* * * * *